US006972648B2

(12) United States Patent
Brown et al.

(10) Patent No.: US 6,972,648 B2
(45) Date of Patent: Dec. 6, 2005

(54) BROADBAND COAXIAL TRANSMISSION LINE USING UNIFORMLY DISTRIBUTED UNIFORM MISMATCHES

(75) Inventors: Jeffrey Brown, Windham, ME (US); John Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 59 days.

(21) Appl. No.: 10/625,551

(22) Filed: Jul. 24, 2003

(65) Prior Publication Data

US 2005/0017826 A1 Jan. 27, 2005

(51) Int. Cl.[7] ..... H01P 3/06; H01P 1/00; H01P 5/00

(52) U.S. Cl. ..... 333/244; 333/260

(58) Field of Search ..... 333/244, 33, 134, 333/209, 245, 260; 324/646; 343/731; 439/33

(56) References Cited

U.S. PATENT DOCUMENTS 2,419,985 A * 5/1947 Brown ..... 333/33
2,445,348 A * 7/1948 Ford ..... 324/646
2,588,103 A * 3/1952 Fox ..... 333/209
2,654,868 A * 10/1953 Zaleski ..... 333/33
3,364,489 A * 1/1968 Masters ..... 343/731
3,460,072 A * 8/1969 Zeigler, Jr. ..... 333/33
3,975,581 A * 8/1976 Lowenhar ..... 333/33
4,019,162 A 4/1977 Banning
4,799,036 A * 1/1989 Owens ..... 333/260
4,831,346 A * 5/1989 Brooker et al. ..... 333/260
5,401,173 A 3/1995 Grandchamp et al.
5,455,548 A 10/1995 Grandchamp et al.
5,999,071 A * 12/1999 Ostertag ..... 333/245
6,538,529 B1 * 3/2003 Stenberg et al. ..... 333/134
6,816,040 B1 * 11/2004 Brown et al. ..... 333/244
6,870,443 B2 * 3/2005 Stenberg et al. ..... 333/134

OTHER PUBLICATIONS

U.S. Appl. No. 10/423,924, filed Apr. 28, 2003, Brown et al., pending.

* cited by examiner

*Primary Examiner*—Patrick Wamsley
(74) *Attorney, Agent, or Firm*—Baker & Hostetler LLP

(57) ABSTRACT

A coaxial transmission line having intermediary segments of equal lengths and equidistant insulator supports is provided. The transmission line segment and insulator support spacing is designed to cause any reflection artifacts to occur outside or between desired channel bands.

23 Claims, 3 Drawing Sheets

BROADBAND COAXIAL TRANSMISSION LINE USING UNIFORMLY DISTRIBUTED UNIFORM MISMATCHES

FIELD OF THE INVENTION

The present invention relates generally to a broadband transmission line. More particularly, the present invention relates to a segmented coaxial transmission line with enhanced broadband capabilities.

BACKGROUND OF THE INVENTION

With the onset of digital broadcast television and radio, the multiplexing of multiple stations onto a single antenna system has been a common approach for addressing the overcrowding of towers. Since multiple stations broadcast on different channels (i.e. frequencies), the antenna transmission line for the antenna system must operate efficiently over a wide frequency range. Multi-station applications require optimum performance at all channels across possible channel bands because, in many cases, the specific channels may not be known at the time of installation.

Transmission lines for broadcast systems are usually coaxial in nature and very long, therefore, requiring their fabrication by joining several smaller coaxial transmission lines together. The joints formed at the junction of the smaller lines unavoidably create flange joints, whereby reflections of the propagating signals are generated in the lines. Additionally, to maintain the necessary separation between the inner conductor and the outer conductor of the coaxial line, a series of insulating supports are interspersed within the line at specified locations. The presence of these insulating supports inherently disturb the electric field in the transmission line and causes reflection of the propagating signal.

The enormous quantity of supports in a long run can cause reflections to add up at certain frequencies, thus degrading the overall performance of the transmission line. It has been common practice to place the supports at points fixed relative to one end of each transmission line section, wherein the fixed points to minimize reflections have been determined either through simulation or experimentation.

Conventional approaches to minimizing the reflections at the flange joints have resulted in the predominant practice of designing transmission line segment/section lengths in non-uniform lengths. These approaches utilize varied section lengths and/or grouping of support insulators in identical pairs with the individual supports located one quarter wavelength from their mate. By arranging the individual supports in this manner, at the desired frequency, the ensuing support induced reflections cancel and the support pairs become "transparent". Any reflection from the supports increases as the operating frequency deviates from the design frequency with which the quarter wavelength spacing is based upon.

The bandwidth of this type of transmission line is dependent upon (1) the magnitude of the reflection generated by an unpaired support, (2) the error in the equality of the reflection generated by the supports constituting a pair, and (3) the positioning pattern used to locate the pairs within the line or line sections. Given these factors, transmission lines have been fabricated to have the insulators designed with a minimal effect, and then compensating for the minimal effect by modifying the inner conductor at the support point. The above ability to create substantially duplicate supports and canceling reflections for the support pair is a trade art based on the choice of insulation material employed and the accuracy of the positioning of the support and its compensation profile about the inner conductor.

Conventional techniques have resulted in the very accurate duplication of supports and accurate positioning of the supports, concomitant with the use of varied dimensions and spacing intervals for the transmission line section lengths. However, these approaches are based on the principal of avoiding repeated dimensions in the transmission line. Unfortunately, this has resulted in requiring a significant amount of man hours in designing and implementing transmission lines with minimal reflections. The transmission line community has not significantly progressed beyond the above paradigm for providing a broadband rigid coaxial transmission line with reduced reflections.

Therefore, there has been a long standing need in the transmission line community for a new approach to designing transmission lines that are simpler and have the desired frequency responses.

SUMMARY OF THE INVENTION

The foregoing needs are met, to a great extent, by the present invention, wherein difficulties in the prior art are mitigated by using substantially equivalent lengths of transmission line sections and supports which are equally spaced therein. These and other advantages of the invention are discussed in greater detail below.

In accordance with one embodiment of the present invention, systems and methods for an improved transmission line is provided by joined segments of coaxial transmission lines, the segments being of substantially the same length and a plurality of insulating supports arranged within the segments, the supports being substantially equidistantly positioned at and between flange joints, wherein the distance between supports is substantially one half a wavelength of a frequency that is outside a channel band.

In another embodiment of the present invention systems and methods for an improved transmission line is provided by a broadband coaxial transmission line, comprising joined segments of coaxial transmission lines, the segments being of substantially the same length, and a plurality of substantially identical first and second insulating supports, wherein the first insulating supports are positioned at flange joints within the joined segments and the second insulating supports are positioned within the joined segments at equidistant intervals from each other and equidistant from the first insulating supports, the distance between any of the insulating supports being approximately one half a wavelength of a frequency that is outside a channel band of an operating range of the transmission line.

There has thus been outlined, rather broadly, certain embodiment(s) of the invention in order that the detailed description thereof herein may be better understood, and in order that the present contribution to the art may be better appreciated.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Conventional rigid coaxial transmission lines are known to suffer from reflections arising from flange joints and the presence of insulating supports. Attempts have been made in the prior art to address these deficiencies by, for example, employing formulated section lengths and reducing the permittivity or size of the insulating supports.

Formulated section lengths are understood to reduce reflections by altering the lengths of the transmission line sections in a non-periodic manner. The non-periodicity causes perturbations in the signals to not significantly accumulate or "resonate" as they travel along the line. Several methods for formulating section lengths are available.

One such method, for example, in U.S. patent application Ser. No. 10/423,924 filed Apr. 28, 2003 titled "BROADBAND RIGID COAXIAL TRANSMISSION LINE", by Brown et al., the contents of which are herein incorporated by reference in its entirety, describes a formula for optimizing transmission lines section length as $$\Delta L(n)=K((n-1)/N)^{\mu} \text{ for } n=1 \ldots N \quad \text{(Eq. 1)}$$

by $$Lg(n)=L-\Delta L(n) \text{ for } n=1 \ldots N, \quad \text{(Eq. 2)}$$

where n is an arbitrary index, N is the total number of line sections in the line run, L is the length of the longest section in the line run, Lg(n) is the length of a segment at index n, and K and $\mu$ are constants determined to be optimal for the value of L for the range of frequencies over which the line is to operate and the attenuation rate of the line.

Other optimizations of the transmission line segment lengths can be found in U.S. Pat. No. 5,401,173 titled "COAXIAL CONNECTOR ACCOMMODATING DIFFERENTIAL EXPANSION", by Grandchamp et al. issued Mar. 28, 1995, and U.S. Pat. No. 4,019,162 titled "COAXIAL TRANSMISSION LINE WITH REFLECTIVE COMPENSATION", by Banning issued Apr. 19, 1997, the contents of which are incorporated herein, in their entirety.

Grandchamp et al. in U.S. Pat. No. 5,455,548, for example, has demonstrated a transmission line with reduced reflections for the case of K= $\lambda/2$ and $\mu$=1, where $\lambda$ is the wavelength of the nominally selected frequency. Notwithstanding Grandchamp's enhanced formulation for the section lengths of the transmission line, it is well understood that in addition to the flange joints, reflections are generated by each of the insulating supports which operate to separate the outer conductor from the inner conductor. Even with the supports designed with a nominal permittivity, the quantity of supports over the span of a long run of transmission line can cause reflections to add up at certain frequencies, thereby degrading the overall performance of the transmission line signal.

Figure 1:
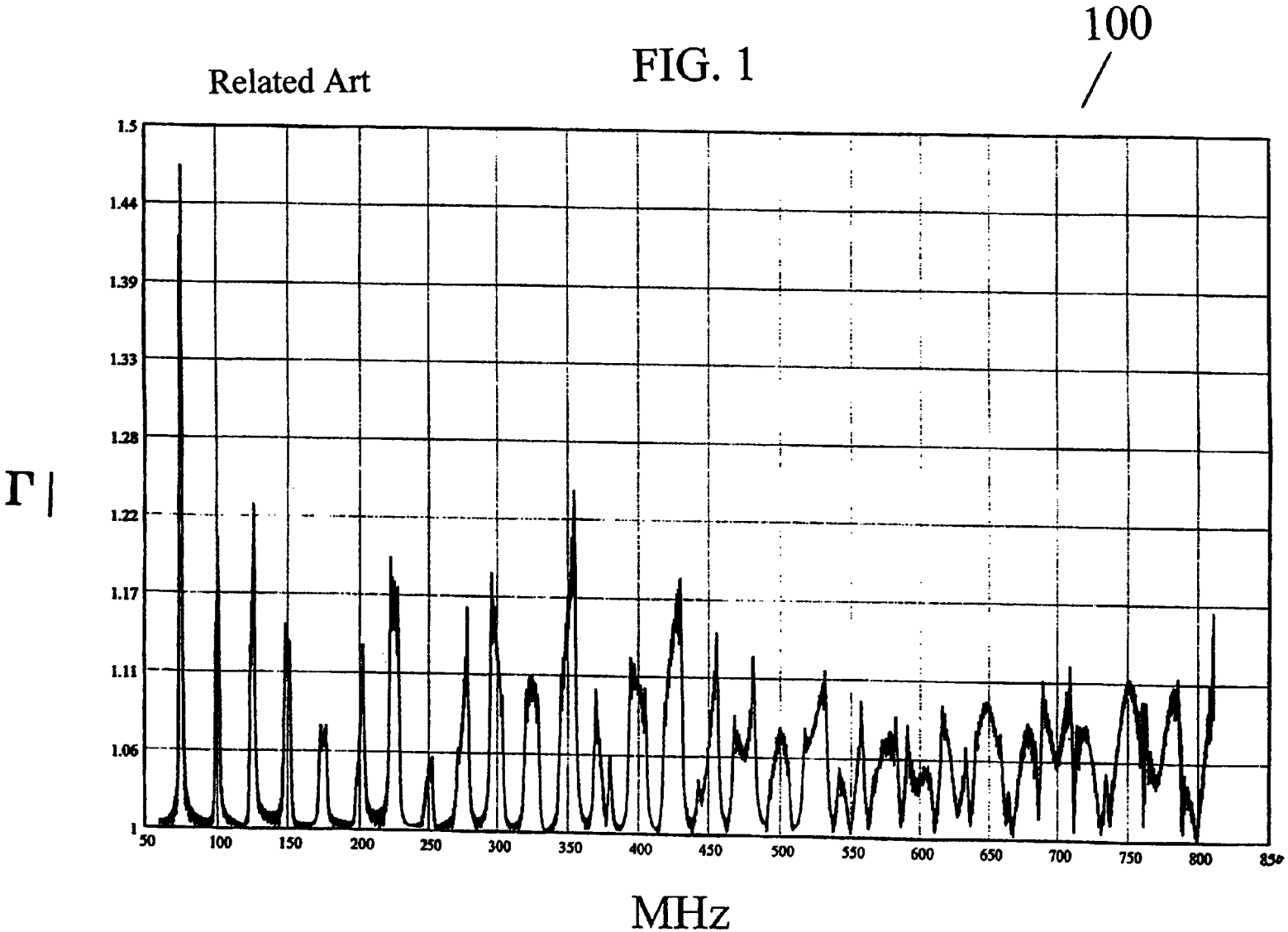
FIG. 1 Related Art
FIG. 1 is a graph of the input reflection coefficient response for a conventional coaxial transmission line operating in the frequency band of 50 MHz to 810 MHz using a positioning algorithm.

FIG. 1 is a graph of the simulated reflection coefficient (|Γ|) 100 for a typical multi-segmented, multi-supported transmission line terminated with a match load and excited with a broadband input signal. Segments and supports are both of conventional arrangements, having varying segment lengths optimized according to a formulation, such as, for example provided in Grandchamp et al.'s U.S. Pat. No. 5,455,548. The transmission line is approximately 1,691 feet long has $\mu$=1.0, and contains 86 segments (N). The ΔL (initial) is 8.2 and a frequency signal of 60 MHz–810 MHz is injected into the transmission line. The flanges and supports were chosen to have voltage standing wave ratio (VSWR) of 1.004 for the purposes of this simulation.

From FIG. 1, it is clearly evident that, not withstanding the varied segment length optimization approach implemented in this example, input reflection coefficient spikes having amplitudes in excess of 1.11 are demonstrated in the lower frequency range. And only a handful of input reflection coefficient spikes are below 1.06. Therefore, even with the use of an "optimized" transmission segment length algorithm, with "matched" insulator supports, the transmission line of FIG. 1 still contains undesirable spikes.

Figure 2:
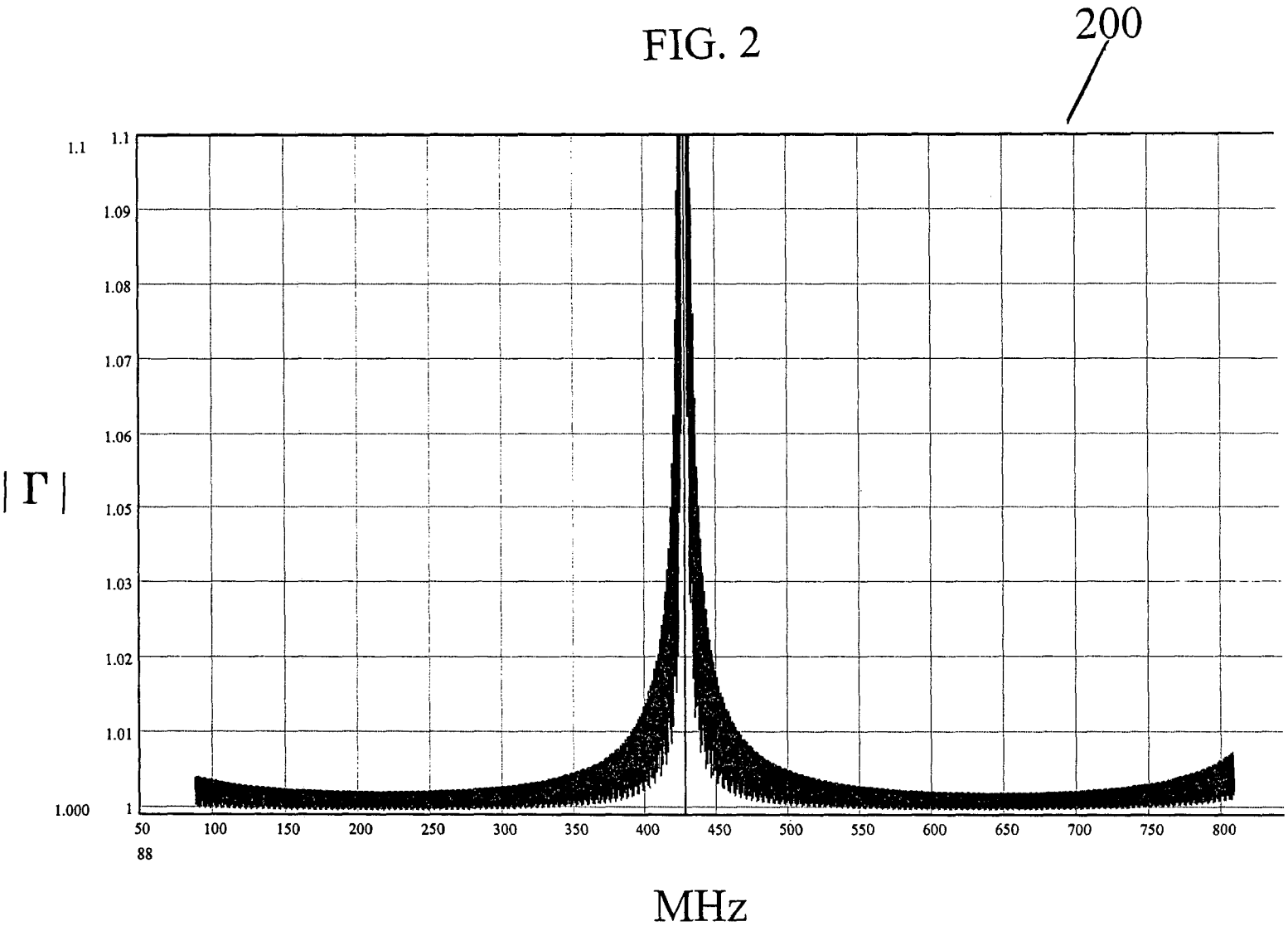
FIG. 2 is a graph of the input reflection coefficient response for an exemplary transmission line utilizing an equal spacing approach according to this invention.

FIG. 2 is a simulation graph illustrating the an input reflection coefficient (|Γ|) response 200 for an exemplary transmission line according to this invention. A frequency of 88 MHz–808 MHz is injected into the exemplary transmission line. The exemplary transmission line is 2063 feet and is composed of 300 smaller "equal" length transmission line sections. Each transmission line section is of approximately 233.75 inches with insulators interposed in the transmission line section spaced at approximately 13.75 inches from each other. The flanges and supports were chosen to have VSWR of 1.004. To ensure that the insulators are equally spaced and also collocated at the flange joints, the transmission line section lengths are set at an integer multiple of the insulator spacing. In this example, the integer multiple is 17. However, other multiples maybe used as desired.

As is evident from FIG. 2, the input reflection coefficient response is below 1.03 from 88 MHz to approximately 400 MHz. From 400 MHz to 450 MHz the input reflection coefficient demonstrates a spike at about 425 MHz. However, this spike is not within the frequency bands of the VHF, FM and UHF channels and, therefore, will not interfere with transmitted VHF, FM or UHF signals. A second harmonic of the 425 MHz spike occurs at 850 MHz (outside the range of the measurement), which is beyond the above mentioned channels. It should be noted here that due to accumulated quantization errors in the plotting of the simulation, the input reflection coefficient of FIG. 2 has oscillation points that appear to be below 1.0. It is, of course, understood that this is a round off artifact and that the input reflection coefficient, in actuality, does not go below 1.0.

Alternative spacing between the insulator supports will cause the reflection coefficient spikes to move within the spectrum. For example, the reflection coefficient spike can be moved outside the UHF band with 2 inch spacings between the insulators. Therefore, alternative embodiments may be facilitated by adjusting the spacing (and attendant transmission line section lengths), without departing from the scope and spirit of this invention. The equal length segments and support spacings of this exemplary transmission line will allow a broadcast or a group of broadcasters to combine signals from any time-harmonic electromagnetic signal, including, but not limited to that of the HF, AM, FM, VHF, UHF, or IBOC (digital FM broadcast) bands to be transmitted into a single run tower.

Figure 3:
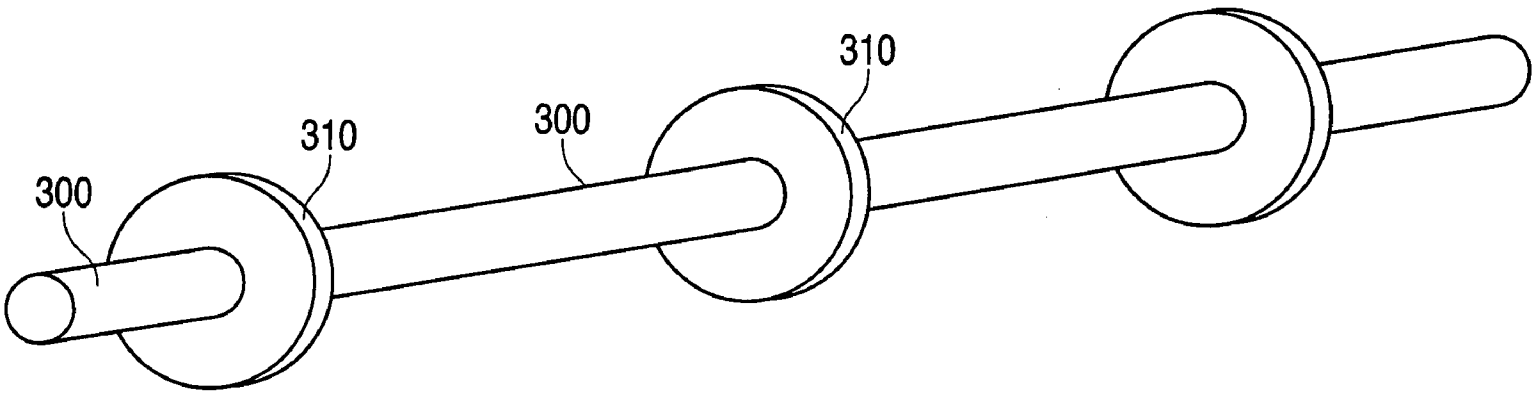
FIG. 3 is an illustration of a coaxial transmission line having insulating supports.

FIG. 3 is an illustration of a coaxial transmission line 300 having insulating supports 310. From the above, it is apparent that the points of addition for the insulators may be moved up the respective bands by decreasing the spacing, and down the respective bands by increasing the spacing. The longer the spacing between the insulators, the more narrow the acceptable bands become, because points of addition occur in octaves of the first addition. It should be noted here that the points of addition can be demonstrated as occurring at wavelengths corresponding to twice the distances between insulators. That is, for example, a spacing of 13.75 inches corresponds approximately to the wavelength of 850 MHz, which is the first octave of the addition point at 425 MHZ. Therefore, based on this relationship between the spacing and the addition point, the exemplary transmission line can be designed to provide broadband fidelity for channels other than those demonstrated herein and may be used for other time-harmonic electromagnetic signals.

The above exemplary transmission line is less subject to incremental error between the supports and the inherent impedance of the inner conductor, outer conductor combination. Thus, it is less affected by variation in tubing sizes which are inherently less accurate than the machining operations associated with fabricating flange joints and supports. In view of the above, care must be exercised in fabricating the supports to ensure the desired performance of the transmission line.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A broadband coaxial transmission line, comprising:

joined segments of coaxial transmission lines, the segments being of substantially the same length; and a plurality of substantially identical first and second insulating supports, wherein the first insulating supports are positioned at flange joints within the joined segments and the second insulating supports are positioned within the joined segments at equidistant intervals from each other and equidistant from the first insulating supports, the distance between any of the insulating supports being approximately one half a wavelength of a frequency that is outside a channel band of an operating range of the transmission line.

2. The transmission line of claim 1, wherein the frequency is outside a UHF band.

3. The transmission line of claim 1, wherein the frequency is outside a VHF band.

4. The transmission line of claim 1, wherein the frequency is outside a FM band.

5. The transmission line of claim 1, wherein the frequency is outside a AM band.

6. The transmission line of claim 1, wherein the frequency is outside an IBOC band.

7. The transmission line of claim 1, wherein the frequency is outside a HF band.

8. The transmission line of claim 1, wherein the length of the transmission line segments is an integer multiple of the distance between any of the insulating supports.

9. A method for designing a broadband coaxial transmission line, comprising the steps of:

joining segments of substantially identical transmission lines of substantially identical lengths;

arranging a plurality of insulating supports within the joined segments, so that the insulating supports are substantially equidistant from each other and the distance between any of the insulating supports is approximately one half a wavelength of a frequency that is outside a channel band of an operating range of the transmission line.

10. The method according to claim 9, wherein the insulating supports are arranged with an equidistant separation that corresponds to approximately one half of a wavelength of a frequency that is outside a UHF channel.

11. The method according to claim 9, wherein the insulating supports are arranged with an equidistant separation that corresponds to approximately one half of a wavelength of a frequency that is outside a VHF channel.

12. The method according to claim 9, wherein the insulating supports are arranged with an equidistant separation that corresponds to approximately one half of a wavelength of a frequency that is outside a FM channel.

13. The method according to claim 9, wherein the insulating supports are arranged with an equidistant separation that corresponds to approximately one half of a wavelength of a frequency that is outside a AM channel.

14. The method according to claim 9, wherein the insulating supports are arranged with an equidistant separation that corresponds to approximately one half of a wavelength of a frequency that is outside an IBOC channel.

15. The method according to claim 9, wherein the insulating supports are arranged with an equidistant separation that corresponds to approximately one half of a wavelength of a frequency that is outside a HF channel.

16. The method according to claim 9, wherein the joined transmission line segments are of a length that is an integer multiple of the separation between supports.

17. A broadband coaxial transmission line, comprising:

joined segments of substantially equal length electrical signal transmitting means for transmitting a signal from a source to a load; and a plurality of substantially identical supporting means for separating an inner conductor of the transmitting means from an outer conductor of the transmitting means, the supporting means positioned in the electrical signal means at substantially equidistant intervals, wherein the substantially equidistant intervals correspond to approximately one half a wavelength of a frequency that is outside a channel band of an operating range of the electrical signal transmitting means.

18. The broadband electrical signal transmitting means of claim 17, wherein the frequency is outside a UHF band.

19. The broadband electrical signal transmitting means of claim 17, wherein the frequency is outside a VHF band.

20. The broadband electrical signal transmitting means of claim 17, wherein the frequency is outside a FM band.

21. The broadband electrical signal transmitting means of claim 17, wherein the frequency is outside a AM band.

22. The broadband electrical signal transmitting means of claim 17, wherein the frequency is outside a HF band.

23. The broadband electrical signal transmitting means of claim 17, wherein the frequency is outside an IBOC band.

* * * * *